US005157809A

United States Patent [19]

Genevray

[11] Patent Number: 5,157,809

[45] Date of Patent: Oct. 27, 1992

[54] CHARGER FOR FEEDING A CARDING MACHINE WITH A LAYER OF TEXTILE FIBERS AS REGULARLY AS POSSIBLE

[75] Inventor: Henri Genevray, Guebwiller, France

[73] Assignee: N. Schlumberger et Cie, S.A., Guebwiller, France

[21] Appl. No.: 611,666

[22] Filed: Nov. 13, 1990

[30] Foreign Application Priority Data

Nov. 13, 1989 [FR] France ..... 89 15020

[51] Int. Cl.[5] ..... D01E 15/40

[52] U.S. Cl. ..... 19/105; 19/0.21

[58] Field of Search ..... 19/0.2, 0.21, 0.22, 19/98, 99, 105, 145.5, 81, 85, 97.5, 145.7, 204, 205

[56] References Cited

U.S. PATENT DOCUMENTS

| | | | |
|---|---|---|---|
| 3,552,800 | 1/1971 | Truetzschler | 19/105 |
| 4,028,872 | 6/1977 | Kotter et al. | 19/105 |
| 4,154,485 | 5/1979 | Lytton et al. | 19/105 |
| 4,387,486 | 6/1983 | Keller et al. | 19/105 |
| 4,397,065 | 8/1983 | Bettoni et al. | 19/105 |
| 4,520,530 | 6/1985 | Pinto | 19/105 |
| 4,535,511 | 8/1985 | Leifeld et al. | 19/105 |
| 4,657,444 | 4/1987 | Pinto | 19/105 |
| 4,779,311 | 10/1988 | Leifeld | 19/105 |
| 4,823,440 | 4/1989 | Pinto | 19/105 |
| 4,858,277 | 8/1989 | Pinto et al. | 19/105 |
| 4,993,119 | 2/1991 | Roberson | 19/97.5 |
| 5,044,046 | 9/1991 | Pinto et al. | 19/145.5 |
| 5,072,491 | 12/1991 | Pinto et al. | 19/145.5 |

FOREIGN PATENT DOCUMENTS

| | | | |
|---|---|---|---|
| 286950 | 10/1988 | European Pat. Off. | 19/105 |
| 2139284 | 2/1972 | Fed. Rep. of Germany . | |
| 3141537 | 5/1983 | Fed. Rep. of Germany | 19/105 |
| 969198 | 12/1950 | France . | |
| 2296034 | 7/1976 | France . | |
| 2599055 | 11/1987 | France . | |
| 8903439 | 4/1989 | PCT Int'l Appl. | 19/145.5 |
| 1216264 | 3/1986 | U.S.S.R. | 19/105 |
| 2171677 | 9/1986 | United Kingdom | 19/145.5 |
| 2229200 | 9/1990 | United Kingdom | 19/105 |

*Primary Examiner*—Werner H. Schroeder
*Assistant Examiner*—Michael A. Neas
*Attorney, Agent, or Firm*—Young & Thompson

[57] ABSTRACT

The present invention relates to a charger for feeding a carding machine with a nap of textile fibers as regularly as possible, characterized in that the receptacle apron (5) is continuously driven at variable speed controlled by the cell (7 ) for control of the thickness of the fiber mat (4) on the spiked apron (6), in that the receptacle (2) is also provided at its outlet, above the receptacle apron (5), with a screed (8) for regulation of the flow of fibers and in that a regulator drum (9) of variable speed coacts with the spiked apron (6) for the regulation of the mat of fibers carried thereon.

3 Claims, 2 Drawing Sheets

CHARGER FOR FEEDING A CARDING MACHINE WITH A LAYER OF TEXTILE FIBERS AS REGULARLY AS POSSIBLE

FIELD OF THE INVENTION

The present invention relates to the field of treating textile fibers, particularly by means of a carding machine for animal, vegetable and chemical fibers, particularly a charger adapted to feed it with a layer of textile fibers as regularly as possible.

BACKGROUND OF THE INVENTION

Known chargers of this type generally receive their reserve of fibers pneumatically, by manual charging or from a charging bin. The reserve rests on a receptacle apron, is seized by a spiked apron, is detached therefrom by the doffer and falls in the adjustable discharge hopper with an oscillating wall. Delivery cylinders then move this supply onto the feed apron feeding the carding machine.

At present, the control of all these members is effected in the following way: a photoelectric cell controls the level of fibers in the reserve and, as soon as a predetermined height of fibers is achieved, the cell is occluded, giving a stop signal to the fan feeding the clumps of fibers. When the level of the fibers in the receptacle falls below the level of the cell, such that the cell is again triggered, the fan bringing the fibers is restarted. The thickness of the fiber mat which the spiked apron conveys toward the hopper is controlled by another cell placed adjacent said spiked apron.

The charging of the spiked apron is effected according to the same principle as that of the receptacle, which is to say the thickness of the fiber mat is controlled by the cell which is occluded when said thickness is too great, which sends a stop signal to the charger and, when the thickness of the mat is returned to normal, the cell is triggered and controls a return to operation of the charger.

A third cell is disposed at the entrance to the hopper and is adapted to control the stopping or starting of the charger, according to the same principle as that described above, as a function of the height of the material located in the hopper.

The different control points of the charger control it totally or not at all, which is to say stopping it or starting it, which has several drawbacks for the charger of a carding machine.

Thus, the adjustment of the thickness of the layer of material which the charger must deliver to the carding machine is difficult to regulate, such that the carding machine is fed in an irregular manner and the resulting product is also irregular, of doubtful quality, which gives rise to large variations in the specific weight of the mass of fibers.

Moreover, the conveyance of the material toward the carding machine is necessarily discontinuous because the operation of the charger is discontinuous and subject to numerous stops and starts which gives rise to the same drawbacks described above, namely, an irregular product and poor quality resulting in large variations of the specific weight of the mass of fibers.

Finally, the different constituent devices such as the receptacle apron, the spiked apron, the delivery cylinders and the movable regulator are controlled by a constant speed motor, such that there is a lack of flexibility, which also contributes to the irregularity of feed of the carding machine.

SUMMARY OF THE INVENTION

The present invention has for its object to overcome these drawbacks.

It thus has for its object a charger for feeding a carding machine with a layer of textile fibers as regularly as possible, which is essentially constituted by a receptacle fed with tufts of fibers by a fan, and provided with a cell for the control of the level of the fibers effecting the operation and stopping of the fan, by a receptacle apron extending below this latter, by a spiked apron gathering the fibers arriving from the receptacle apron, by a control cell for the thickness of the fiber mat on the spiked apron, by a hopper of adjustable span with an oscillating wall fed by the spiked apron and provided, at its lower portion, with delivery cylinders coacting with a feed apron effecting feed of the carding machine, characterized in that the receptacle apron is continuously driven at a variable speed controlled by the control cell for the thickness of the fiber mat on the spiked apron, in that the receptacle is provided also at its outlet above the receptacle apron, with a screed for regulating the flow of fibers and in that a movable variable speed regulating drum coacts with the spiked apron for regulating the fiber mat taken up by this latter.

BRIEF DESCRIPTION OF THE DRAWINGS

The invention will be better understood from the following description, which relates to a preferred embodiment, given by way of non-limiting example, and explained with reference to the accompanying schematic drawings, in which.

DESCRIPTION OF THE PREFERRED EMBODIMENT

Figure 1:
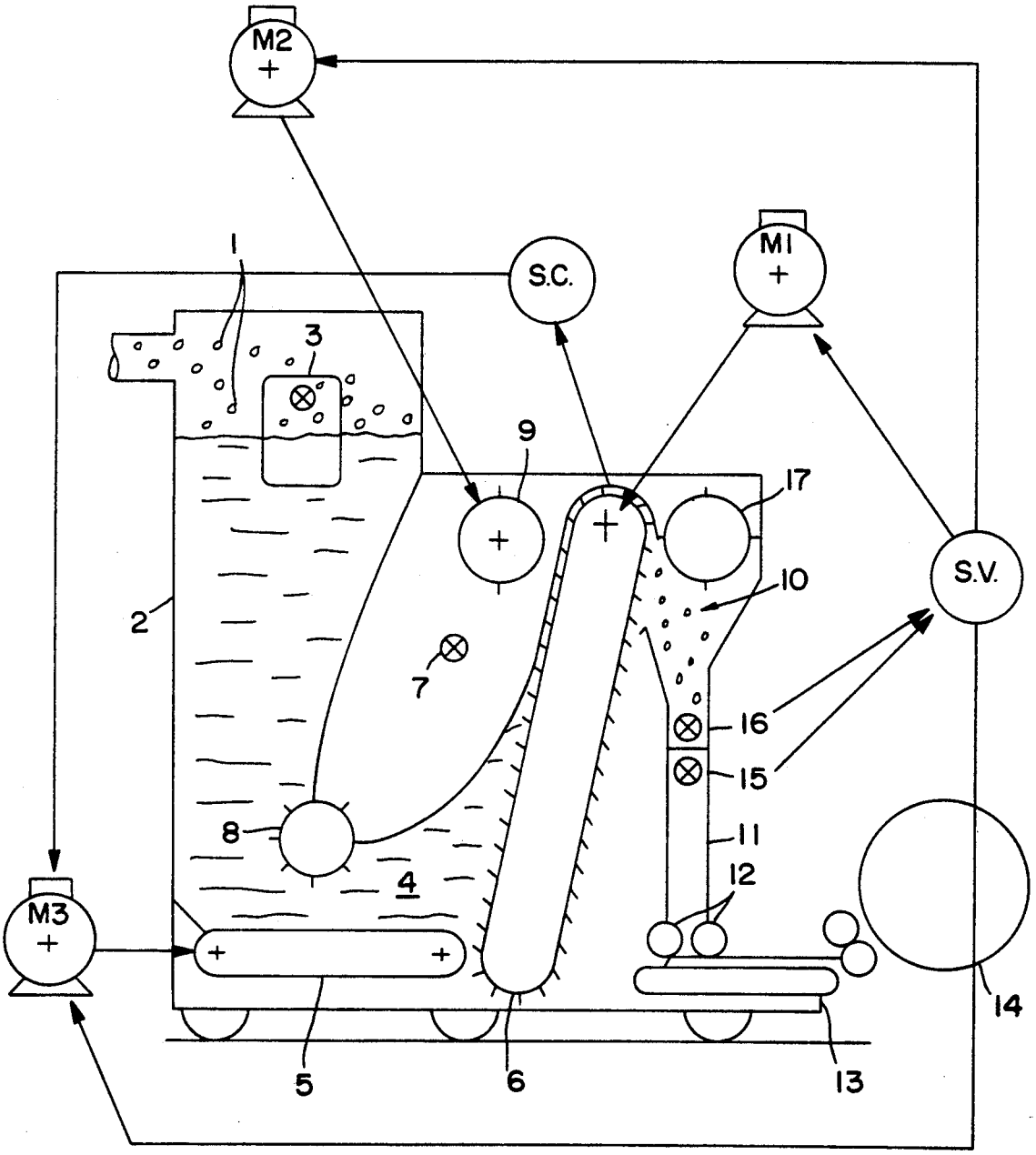
FIG. 1 is a cross-sectional view of the charger according to the invention.
Figure 2:
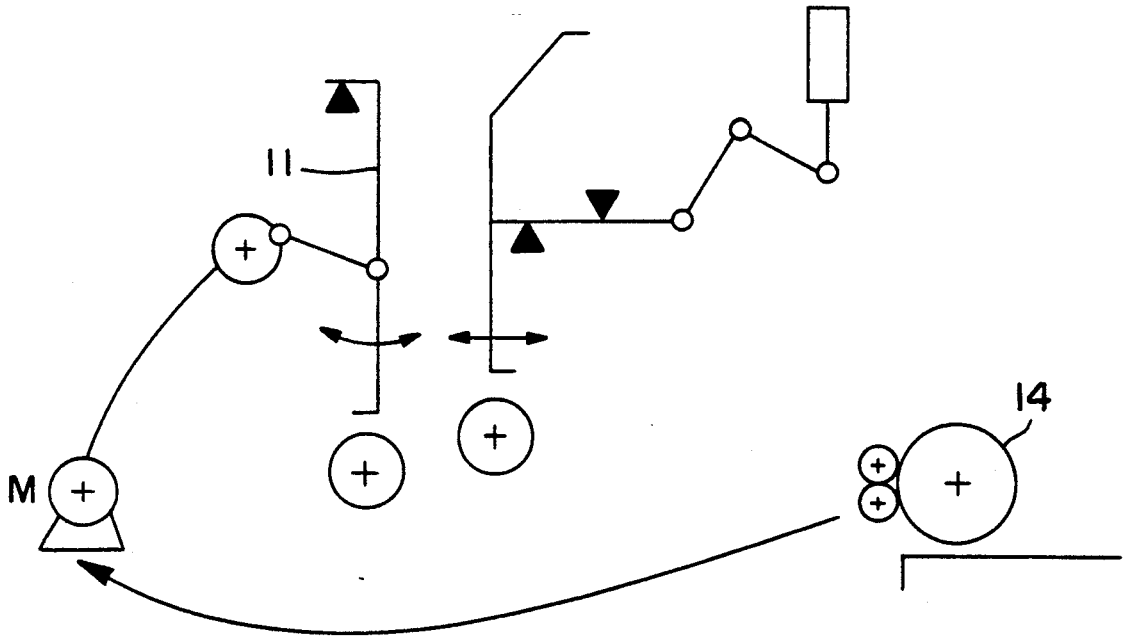
FIG. 2 depicts a hopper having an adjustable width and an oscillating wall.

The accompanying drawing figure shows a charger for the feed of a carding machine 14 with a layer of textile fibers as regularly as possible, which is essentially comprised by a receptacle 2 fed with flocks 1 of fibers by a fan, not shown, and provided with a control cell 3 for the level of the fibers controlling the starting and stopping of the fan. A receptacle apron 5 is disposed beneath this latter and carries the fibrous material 4 to a spiked apron 6. The thickness of the fiber mat on the spiked apron 6 is controlled by a cell 7, then said material is carried to a hopper 11 of adjustable width and with an oscillating wall fed by the spiked apron 6 and provided at its lower portion with delivery cylinders 12 coacting with a feed apron 13 effecting the feed of the carding machine 14.

According to the invention, the charger is provided with a receptacle apron 5 which is driven by a motor M3 at continuously variable speed via speed control system which controls SC the thickness of the fiber mat on the spiked apron 6.

Moreover, the receptacle 2 is provided at its outlet, above the receptacle apron 5, with a screed 8 for regulating the fiber flow leaving said receptacle 2 and a rotatable variable speed regulating drum 9 driven by a motor M2 coacts with the spiked apron 6 for the control of the fiber mat carried thereon. The spiked apron 6 is also driven by a motor M1.

The flocs 1 of fibers are brought to the receptacle 2 by the fan, not shown, and their level in said receptacle 2 is controlled by the cell 3 which, as soon as it is operated, maintains the operation of the fan and, as soon as it is occluded, controls the stopping of this latter.

The fibrous material 4, which rests on the receptacle apron 5, is brought by this receptacle apron 5 to the spiked apron 6 and the thickness of the fiber mat 4 on the spiked apron 6 is controlled by the cell 7. This cell 7 controls the speed of the charger while permitting operation at normal speed when it is operated and operation at minimum predetermined speed when it is occluded.

Such an operation at minimal speed has the effect of slowing the charging of the spiked apron 6.

According to a characteristic of the invention, the position of the cell 7 relative to the spiked apron 6 and to the receptacle apron 5, is adjustable. Thus, the thickness of the fiber mat on the spiked apron 6 can be adjusted.

The fiber mat driven by the spiked apron 6 is further regulated by the screed 8 and by the regulating drum 9. At its upper end, the spiked apron 6 dumps the bundles 10 of fibers into the hopper 11 of adjustable size and with oscillating wall, by coaction with the doffing cylinder 17, said hopper 11 feeding the carding machine 14 via delivery cylinders 12 coacting with the feed apron 13.

According to a characteristic of the invention, the hopper 11 is provided with two level-control cells 15 and 16 disposed with vertical spacing and controlling via a regulating variable speed system SV associated to motors M1 and M3, the speed of operation of the spiked apron 6, the delivery cylinders 12 and the regulating drum 9, respectively, at maximum speed when the level of fibers in the hopper 11 is below the lower cell 15., at normal speed when the cell 15 is occluded and the cell 16 is exposed, and at minimum speed when both cells are occluded. Thus, it is possible to effect continuous control of the level in the hopper 11 and to maintain this level substantially .constant while providing either a return to the height of the material or a maintenance of this height, or a reduction in height of the material.

The charger according to the invention permits easily effecting an adjustment of the thickness of the layer of fibers which it must deliver to the carding machine, such that this latter is fed in a regular manner and that the output product is also regular and of good quality.

Moreover, the movement of the fibers toward the carding machine is effected in a continuous manner, because the charger turns constantly, which is to say without stopping any of its constituent elements, which contributes also to the regularity and high quality of the output product.

Finally, the movable members such as the receptacle apron 5, the spiked apron 6, the delivery cylinders 12 and the regulator drum 9 being controlled with variable speed, they have a certain flexibility of operation contributing to the regularity of feed of the carding machine 14.

Thanks to the invention, it is possible to provide a charger operating continuously at variable speed to regulate optimally the fibrous material fed to the carding machine.

Of course, the invention is not limited to the embodiment described and illustrated in the accompanying drawing. Modifications remain possible, particularly as to the construction of various elements or by substitution of technical equivalents, without thereby departing from the scope of protection of the invention.

I claim:

1. In a charger for feeding a carding machine with a layer of textile fibers as regularly as possible, said charger comprising: a receptacle (2) adapted to be fed with fiber flocs (1), and provided with a first cell (3) for controlling the level of fibers effecting the starting and stopping of the fan, a receptacle apron (5) extending therebeneath, a spiked apron (6) for grasping the fibers delivered by the receptacle apron (5) thereby forming a mat of fibers on the spiked apron (6), a second cell (7) for controlling the thickness of said mat of fibers (4) on the spiked apron (6), a hopper (11) with variable spacing and oscillating wall fed by the spiked apron (6) and provided, at its lower portion, with delivery cylinders (12) coacting with a feed apron (13) for feeding a carding machine (14), the improvement wherein the receptacle apron (5) includes means for being continuously driven at variable speed controlled by the second cell (7) for controlling the thickness of the mat of fibers (4) on the spiked apron (6), the receptacle (2) is provided at its output, above the receptacle apron (5), with a screed (8) for regulating the flow of fibers and a regulating drum (9) of variable speed coacts with the spikes apron (6) for regulating the mat of fibers carried by said spiked apron (6).

2. Charger according to claim 1, wherein the second cell (7) includes means for adjusting its position relative to the spiked apron (6) and to the receptacle apron (5).

3. Charger according to claim 1, wherein the hopper (11) is provided with two cells (15 and 16) for level control, disposed spaced vertically, and controlling via a variable speed system associated to motors, the drive speed of the spiked apron (6), of the delivery cylinders (12) and of the regulating drum (9), respectively at maximum speed when the level of fibers in the hopper (11) is below the lower cell (15), at normal speed when the lower cell (15) is occluded and the upper cell (16) is exposed, and at minimum speed when both cells are occluded.

* * * * *